United States Patent [19]

Bowles

[11] 4,076,876

[45] Feb. 28, 1978

[54] FOOT TENSION RELAXER

[76] Inventor: Alfred H. Bowles, W. 904 Lincoln Place, Apt. No. 4, Spokane, Wash. 99204

[21] Appl. No.: 792,777

[22] Filed: May 2, 1977

[51] Int. Cl.[2] ..... A47C 9/12

[52] U.S. Cl. ..... 428/71; 36/71; 297/439; 297/DIG. 1; 428/95; 428/102; 428/189; 428/190; 428/315; 428/909

[58] Field of Search ..... 428/95, 102, 159, 160, 428/189, 190, 315, 909, 71; 36/71; 297/DIG. 1, 438, 439, 423

[56] References Cited

U.S. PATENT DOCUMENTS 2,964,421 12/1960 Rockoff ..... 428/95

*Primary Examiner*—Marion E. McCamish

*Attorney, Agent, or Firm*—Wells, St. John & Roberts

[57] ABSTRACT

A foot tension relaxer including a base upon which is mounted three successively narrowing cushion members, with the three cushion members being spanned by a flexible cover member that is attached at its peripheral edges to the base member. The configuration imparted to the flexible cover member by the progressively narrowing juxtaposed cushion members resembles the arch of the human foot. Thus, when a user steps on the flexible cover member, the resilient cushion members react against the weight of the user to gently push upward against the arch to relieve foot tension and pain.

7 Claims, 5 Drawing Figures

FIG 1
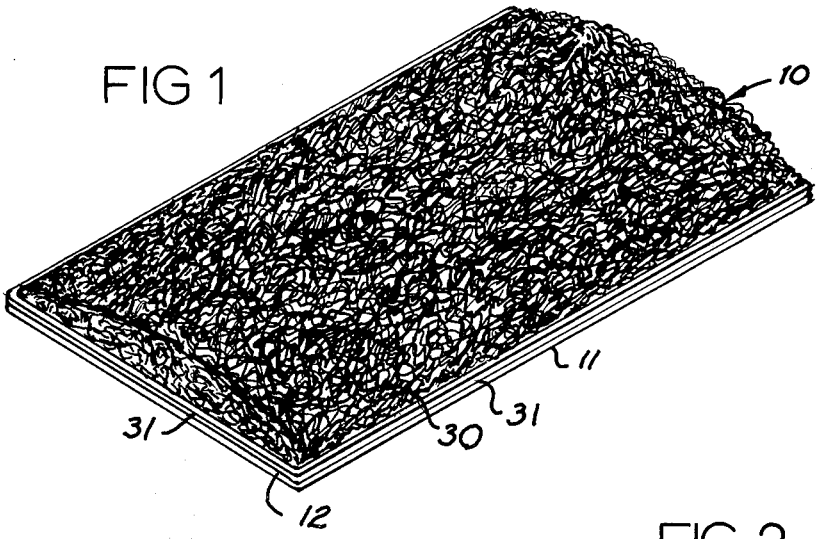
FIG 2
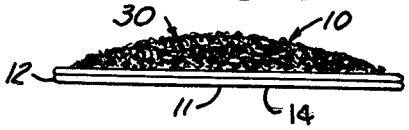
FIG 3
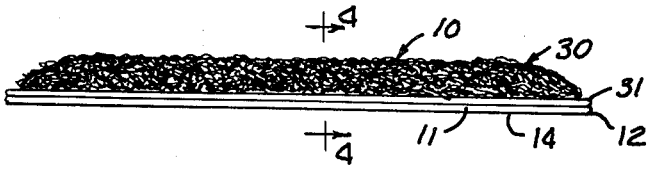
FIG 4
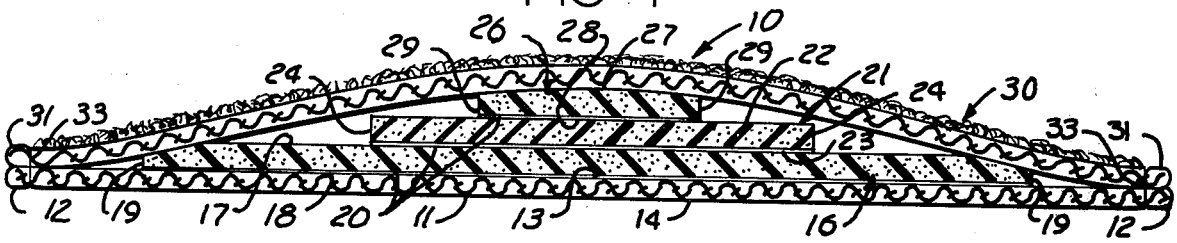
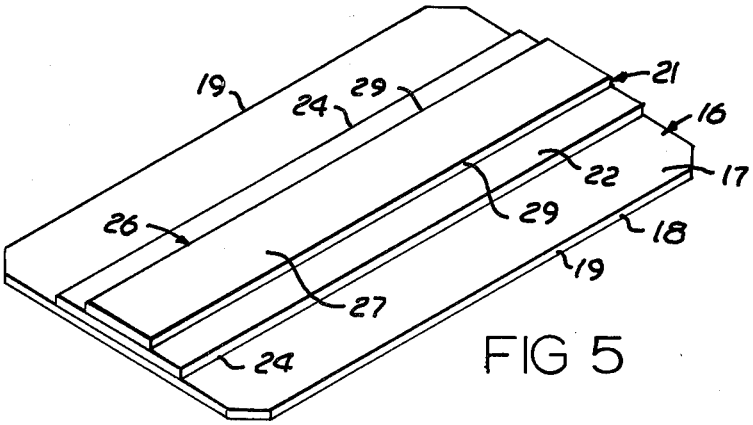
FIG 5

FOOT TENSION RELAXER

BACKGROUND OF THE INVENTION

Many people whose professions require them to remain on their feet for extended periods of time often develop "fallen arches." People also commonly develop foot problems through the passing of years. It is therefore desirable to obtain some form of device that may be utilized in the home or at work to ease foot pain due to tension.

The present invention was developed for the purpose of relaxing tired feet rather than providing sophisticated therapeutic or correctional functions. Its purpose therefore is to relax and massage tired, aching feet, to provide temporary relief and relaxation.

Another important object is to provide such a device that is compact in nature and that may be easily transported.

A still further object is to provide such a device that is very simple in construction and includes inexpensive components, thereby making the device relatively easy to manufacture and inexpensive to purchase.

These and still further objects will become obvious upon reading the following detailed description which, when taken along with the accompanying drawings, describe a preferred form of my invention.

SUMMARY OF THE INVENTION

A foot tension relaxer is described that includes a flat base member having a selected length and width and an areal upper and lower surface. A first cushion member that is slightly less in length and width to the base is fixed to the upper surface of the base along a lower surface thereof. A second cushion member is formed of resilient material and includes a length dimension equal to that of the first cushion member and a width dimension substantially less than the width dimension of the first cushion member. The second cushion member includes a lower surface that is affixed to an upper surface of the first cushion member. The second cushion member is affixed to the first cushion member along its longitudinal center line. A third cushion member is also formed of resilient material and includes a length dimension equal to that of the first and second cushion members and width dimension that is less than that of the second cushion member. It includes a lower areal surface that is affixed to an upper surface of the second member and is centered along the longitudinal center line of the first member. A flexible cover member that is complementary in size to the flat base is joined to the base at the peripheral edges thereof. The flexible cover member extends over the first, second and third cusion members to provide a treading surface to a user.

BRIEF DESCRIPTION OF THE DRAWINGS

A preferred form of the present invention is illustrated in the accompanying drawings in which:

FIG. 1 is a pictorial view of the present device;

FIG. 2 is an end view of the device shown in FIG. 1;

FIG. 3 is a side elevational view;

FIG. 4 is an enlarged sectional view taken substantially along line 4—4 in FIG. 3; and FIG. 5 is a pictorial view of the assembled cushion members of the prevent invention.

DETAILED DESCRIPTION OF THE PREFERRED EMBODIMENT

The cushion embodying the present invention is illustrated in FIG. 1 in its complete configuration. The cushion is designated generally by the reference character 10. Basically, the cushion 10 includes a flat base 11 and a flexible cover member 30. The base and cover members are joined together about their peripheral edges to sandwich a series of three cushion members therebetween. The cushion members are successively smaller in transverse dimension so as to build up the configuration of the cover member 30 to the arched shape as shown in FIGS. 1, 2 and 4.

The base 11 is substantially rectangular in configuration as defined by peripheral side edges 12. It includes a planar upper surface 13 and lower surface 14. It is intended that the base be formed of a flexible material commonly utilized in the carpet making processes. Thus, the base may be formed of jute or, if necessary, may be formed of ordinary carpet remnants. It is preferred that the peripheral edges of the base 11 be provided with a binding to prevent fraying.

The base is of prescribed longitudinal and transverse dimensions. I have found that a particularly useful overall dimension for the base is 13.5 to 14 inches in width and 18 inches in length. This dimension substantially corresponds to the standard dimensions for regular carpet samples which are utilized by the carpet industry and are particularly useful in constructing the present invention.

FIGS. 4 and 5 show the interior of the foot tension relaxer. The interior is made up of a number of juxtaposed strips of flexible resilient material. The strips are affixed to one another and are centered along the longitudinal center line of the base 11 to form the arch configuration assumed by the cover member 30 when in place and fixed to the base member 11.

Specifically, the interior of the relaxer 10 includes three cushion members, the first of which is shown at 16. Cushion member 16 includes a planar areal upper surface 17 and a parallel planar areal lower surface 18. The width of cushion member 16 is defined by longitudinal side edges 19. The distance between the longitudinal side edges 19 is complementary to but slightly less than the width dimension of the base member. As briefly discussed above, the preferred width of the base is 13.5 to 14 inches. Therefore, a base member having a transverse width of approximately 12 inches is appropriate. The length dimension is similarly reduced.

The lower surface 18 of first cushion member 16 includes a covering of a nonporous material as indicated at 20. This nonporous material may be a polyethelene sheet that is glued or otherwise adhered to the lower cushion member surface. This covering 20 is utilized for gluing purposes, allowing the first cushion member 16 to be securely glued to the upper surface 13 of the base member 11. This prevents the cushion member from sliding over the surface 13 of base 11.

The first cushion member and remaining cushion members of my invention include such nonporous coverings on the lower surfaces thereof. Also, the three cusion members shown are formed of material of equal thickness (preferably ½ inch) and are formed of a porous resilient material such as foam rubber or a similarly foamed synthetic resin material. It is essential that the material have the characteristic of resiliency in order to spring back to its original configuration after being trod upon by the user, and to gently press upwardly against the user's foot when tread upon.

A second cushion member 21 is affixed to the first cushion member along the longitudinal center line of base 11. Second cushion member 21 includes an upper planar surface 22 and a lower surface 23. The width dimension of the second cushion member 21 is defined by longitudinal side edges 24. The dimension between the side edges is approximately one half the width of the first cushion member (preferably 5 to 6 inches). The second cushion member is affixed to the first cushion member through use of an appropriate adhesive applied to the upper surface of the first cushion member and the nonporous lower surface covering of the second surface member.

A third cushion member is indicated at 26. Third cushion member 26 also includes an upper planar surface 27 and a lower planar surface 28. Third cushion member 26 includes longitudinal side edges 29 that are transversely spaced to define a width dimension of the third cushion member that is approximately one half the width dimension of the second cushion member, (preferably 2½ to 3¼ inches). Again, the third cushion member, like the first and second cushion members, includes a nonporous covering along its lower surface 28 and is affixed by adhesive along the central longitudinal center line of the first member 16 to the upper surface 22 of second cushion member 21. This results in a pyramidal shape substantially as shown in FIGS. 4 and 5. It should be noted with particular reference to FIG. 5 that the overall length dimensions of the individual cushion members are substantially equal.

The flexible cover member is indicated at 30 and has been briefly discussed above. Cover member 30 is preferably formed of a standard carpet material and, if the dimensions are appropriate, may be formed of an existing standard carpet sample. At any rate, the flexible cover member is defined by a rectangular peripheral edge 31 that also includes a binding to prevent fraying. This peripheral edge is matched by the peripheral edge 12 of the base 11. Edges 12 and 31 are sewn and are glued together to form the finished product. A typical sewing stitch utilized to join the two peripheral edges and thereby sandwich the cushion members between the base and cover member is illustrated at 33 in FIG. 4. By binding the peripheral edges of the base and cover member together, the cover member will naturally assume the built-up configuration afforded by the three successive narrower cushion members. This configuration by the preferred dimensions is intended to reasonably resemble the arch configuration of a human foot. Thus, when the relaxer is tread upon, it will operate to press upwardly against the arch and relieve tensions in that area as well as the heel and toe area.

It will be noticed that the finished product retains a flat planar surface at the lower base surface 14. This enables the device to be placed on a floor surface and assures that it will remain stationary. On the other hand, the flexible cover member 30 assumes the arched configuration as determined by the built-up cushion members 16, 21 and 26. This arched configuration, as shown in FIG. 3, extends substantially the full length of the relaxer due to the approximate equal lengths of the three joined cushion members. This maximizes the effective area of the relaxer upon which the user may tread.

In use, the user simply places the relaxer on the ground or floor with the lower surface 14 of base 11 in contact with the floor surface. He then merely stands or treads in place upon the flexible cover member 30. Alternatively, the user may simply sit while resting his feet upon the arched surface of cover member 30. However used, the device has shown to be effective in relaxing and relieving tension in tired, sore feet.

It may have become obvious from the above description and accompanying drawings that various changes and modifications may be made therein. However, it is intended that the scope of this invention be inclusive of some additional modifications contemplated but for brevity are not presently disclosed herein. Therefore, only the following claims are to be taken as definitions and limitations upon the scope of my invention.

What I claim is:

1. A foot tension relaxer, comprising:

a flat base of selected length and width dimensions and having areal upper and lower surfaces;

a first cushion member formed of a resilient material with a lesser length and width dimension that the base and having upper and lower areal surfaces thereon with the lower areal surface thereof affixed to the upper surface of the base;

a second cushion member formed of a resilient material having a length dimension equal to that of the first cushion member and a width dimension less than the width dimension of the first cushion member and also having an upper and lower areal surface with the lower areal surface affixed to the upper areal surface of the first cushion member and extending along the longitudinal center line of the first cushion member;

a third cushion member formed of resilient material having a length dimension equal to that of the first cushion member and a width dimension less than that of the second cushion member and also having an upper and a lower areal surface with the lower areal surface affixed to the upper areal surface of the second cushion member and extending along the longutidinal center line of the first cushion member; and a flexible cover member similar in size to the flat base and joined to the base at the peripheral edges thereof such that it covers the first, second and third cushion members and assumes an arched configuration similar to that of the arch of the human foot due to the configuration of the three joined cushion members.

2. The foot tension relaxer as defined in claim 1 wherein the first, second and third cushion members are formed of a porous resilient material;

wherein each cushion member includes a nonporous covering along its lower surface; and wherein the cushion members are affixed to each other and to the base by adhesive.

3. The foot tension relaxer as defined by claim 1 wherein the cover member is formed of a carpeting material.

4. The foot tension relaxer as defined by claim 1 wherein the width of the second cushion member is approximately one half the width of the first cushion member.

5. The foot tension relaxer as defined by claim 1 wherein the width of the third cushion member is approximately one half the width of the second cushion member.

6. The foot tension relaxer as defined by claim 1 wherein the second cushion member is approximately one half the width of the first cushion member; and wherein the width of the third cushion member is approximately one half the width of the second cushion member.

7. The foot tension relaxer as defined by claim 1 wherein the cushion members have equal thickness dimensions between their respective upper and lower surfaces.

* * * * *